United States Patent [19]

Endelson

[11] Patent Number: 4,517,994

[45] Date of Patent: May 21, 1985

[54] FLAT CIGARETTE LIGHTER

[75] Inventor: Robert A. Endelson, New York, N.Y.

[73] Assignee: Microtech Associates, New York, N.Y.

[21] Appl. No.: 442,724

[22] Filed: Nov. 18, 1982

[51] Int. Cl.[3] ..... F23Q 2/16; A24F 47/00

[52] U.S. Cl. ..... 131/329; 131/234; 131/239; 431/150; 206/87

[58] Field of Search ..... 131/329, 330, 178, 234, 131/239; 206/85, 87, 88, 89; 431/130, 131, 150, 142, 143

[56] References Cited

U.S. PATENT DOCUMENTS

| | | | |
|---|---|---|---|
| 1,895,032 | 1/1933 | Fisher | 431/130 |
| 2,697,339 | 12/1954 | Reich | 431/142 |
| 3,092,988 | 6/1963 | Meyers | 431/131 |
| 3,263,456 | 8/1966 | Dexter | 431/131 |
| 3,314,252 | 4/1967 | Kanomaru | 431/131 |
| 3,608,704 | 9/1971 | Kopp | 206/87 |
| 3,976,194 | 8/1976 | Loredo | 206/87 |
| 4,207,032 | 6/1980 | Callaud et al. | 431/150 |
| 4,230,224 | 10/1980 | Weeks | 206/87 |
| 4,250,899 | 2/1981 | Pagani | 131/329 |
| 4,403,945 | 9/1983 | Leitgib | 431/150 |

FOREIGN PATENT DOCUMENTS

| | | | |
|---|---|---|---|
| 2301984 | 7/1974 | Fed. Rep. of Germany | 206/89 |

*Primary Examiner*—V. Millin
*Assistant Examiner*—Harry Macey
*Attorney, Agent, or Firm*—Michael Ebert

[57] ABSTRACT

A gas-fueled cigarette lighter having front and rear walls defined by plates which are joined together by a plurality of ribs to resist pressure produced by the gas, wherein the lighter has a flat ultra-thin format which lends itself to insertion between the inner and outer wrappers of a standard cigarette pack so that the smoker is never at a loss for a light and the inserted lighter functions as a stiffener to prevent crushing of the pack. The lighter is constituted by a card-like body having a shallow reservoir therein filled with liquified gas. Fitting into a corner cut-out in the body is a lighter assembly whose thickness is not greater than that of the body. The assembly includes a valve-controlled nozzle coupled to the reservoir and an adjacent thumb wheel against which a flint is pressed such that when the wheel is turned it abrades the flint to generate sparks that ignite vapor emitted from the nozzle.

2 Claims, 4 Drawing Figures

FLAT CIGARETTE LIGHTER

BACKGROUND OF THE INVENTION

Field of Invention

This invention relates generally to cigarette lighters, and more particularly to a cigarette lighter having a flat ultra-thin format which lends itself to insertion between the inner and outer wrappers of a standard cigarette pack so that the smoker is never at a loss for a light, the flat lighter also functioning as a stiffener for the pack to prevent crushing thereof.

In the past, safety matches were usually used to light cigarettes, such matches being available in match books or match boxes. In recent years matches have largely been supplanted by cigarette lighters capable of supplying hundreds of lights before being exhausted, thereby doing away with the problems involved in striking matches and of disposing of burnt out matches.

The modern cigarette lighter no longer uses gasoline which requires a wick, for the fuel is now a liquified hydrocarbon mixture under pressure in a reservoir. The fuel vapor is emitted through a valve-controlled nozzle, the vapor being ignited by sparks generated by a flint abraded by a thumb wheel. Various arrangements have been heretofore developed to permit the user of the lighter to open the gas valve as the thumb wheel is turned so as to coordinate the action of the wheel and valve.

In the typical low-cost disposable lighter which must be discarded after the fuel is spent, the valve-actuating lever is provided with a thumb key that is placed directly adjacent the thumb wheel. In this way the operator is able with his thumb to concurrently turn the wheel and depress the key to cause the valve to open to discharge vapor which is ignited by sparks generated by the abraded flint.

In more expensive lighters which can be refueled, the operating components usually lie under a hinged protective cowl so that the smoker must first swing open the cowl before operating the thumb wheel and the valve key. Such lighters possess the advantage of being protected against dirt and other contaminants which might otherwise fall into the lighter mechanism when it is stored in a pocket or purse.

Existing cigarette lighters whether of the protectively covered or exposed type are invariably relatively thick three-dimensional structures regardless of their overall shape. Thus should the lighter have a box-like shape or take the form of a rod or cylinder, the thickness of the lighter, even in so-called slim models, is at least $\frac{3}{8}$th of an inch and more commonly one-half inch thick.

The standard cigarette pack houses a cluster of twenty cigarettes within a paper-foil inner wrapper enveloped by a cellophane or transparent plastic-film outer wrapper. To obtain access to the contents, the smoker first uncoils a tear-off ribbon that severs the head of the outer wrapper to expose the inner wrapper which is then torn open at one side to form a port from which cigarettes can be removed.

The shape of a conventional cigarette lighter, regardless of its format is such that the lighter must be kept separate from the pack. Thus while the usual breast pocket in a man's shirt is large enough to accommodate a cigarette pack, there is not sufficient room to also receive the ordinary cigarette lighter. Hence, the lighter when used by a man is usually stored in his jacket or trouser pocket. Women tend to keep their cigarette packs and lighters loosely in handbags.

The standard cigarette pack made of foil paper and plastic film wrappers is soft and compressible, and is therefore easily crushed when subjected to pressure. This may deform or mutilate the contents. Because such crushing is a fairly common experience, some smokers acquire rigid cases to store their soft packs. But crushing is by no means the only problem, for what often happens is that the smoker after using his lighter will forget to return it to his pocket or wherever he normally stores the lighter. He may lay it on a table or some other place and then when he later wishes to light up, the smoker may not be able to find his lighter.

One prior approach to this problem is that disclosed in the Sanchez U.S. Pat. No. 2,998,716 in which a watch-shaped lighter is strapped onto the wrist. Apart from the practical difficulty of using the lighter at a wrist position is the fact that it pre-empts space normally occupied by a wrist-watch.

The Leibow U.S. Pat. No. 2,782,910 suggests another solution. This patent discloses a special mounting to support both a cigarette pack and a lighter, and serving as a rigid support for the pack. The hinged cover of the mounting houses a cigarette lighter mechanism. This special mounting is relatively elaborate and costly.

SUMMARY OF INVENTION

In view of the foregoing, the main object of this invention is to provide a gas-fueled cigarette lighter having a flat format which lends itself to insertion between the inner and outer wrappers of a standard cigarette pack so that the dimensions of the combined pack and lighter are not perceptably greater than those of the pack in the absence of the lighter.

Among the advantages of a cigarette lighter in accordance with the invention are the following:

A. The smoker is never at a loss for a light, for the lighter is where the cigarettes are, and when the smoker reaches for a cigarette he then has access to the lighter;

B. The combined pack and lighter may be snugly stored in a pocket or other place whose dimensions are such that it can normally only accommodate a standard cigarette pack.

C. The flat cigarette lighter acts as a stiffener to prevent crushing of the otherwise soft pack.

More particularly, it is an object of this invention to provide a lighter of the above type in which the operating components thereof are protected by a hinged cowl.

Also an object of the invention is to provide a disposable liquified fuel lighter in a flat format which may be mass-produced and sold at low cost, the lighter satisfying safety requirements for such lighters.

Briefly stated these objects are attained in a gas-fueled cigarette lighter having a flat ultra-thin format which lends itself to insertion between the inner and outer wrappers of a standard cigarette pack so that the smoker is never at a loss for a light and the inserted lighter functions as a stiffener to prevent crushing of the pack. The lighter is constituted by a card-like body having a shallow reservoir therein filled with liquified gas. Fitting into a corner cut-out in the body is a lighter assembly whose thickness is no greater than that of the body. The assembly includes a valve-controlled nozzle coupled to the reservoir and an adjacent thumb wheel against which a flint is pressed such that when the wheel is turned it abrades the flint to generate sparks that ignite vapor emitted from the nozzle.

OUTLINE OF THE DRAWINGS

For a better understanding of the invention as well as other objects and further features thereof, reference is made to the following detailed description to be read in conjunction with the accompanying drawings, wherein.

DESCRIPTION OF INVENTION

Figure 1:
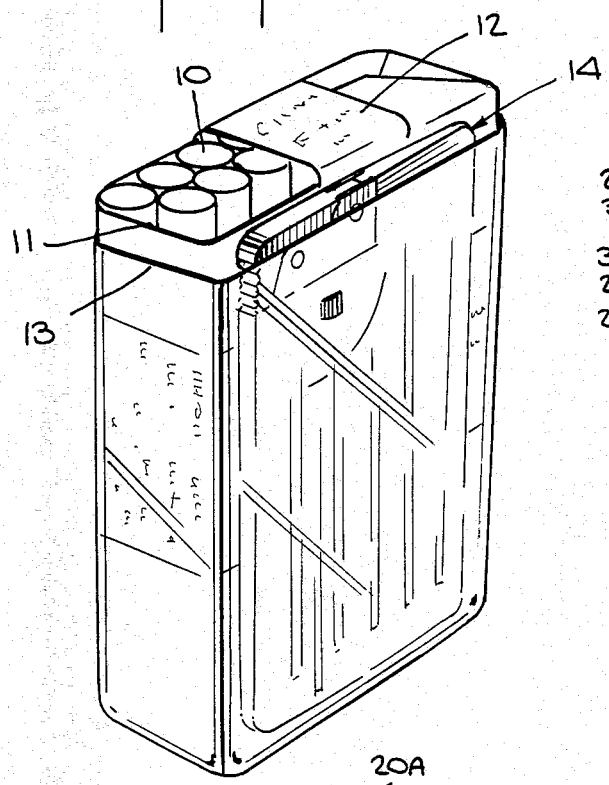
FIG. 1 illustrates in perspective the combination of a standard cigarette pack and a gas-fueled lighter in accordance with the invention.

Referring now to FIG. 1 there is shown a standard cigarette pack for housing a cluster 10 of twenty cigarettes. The pack is constituted by a paper-foil inner wrapper 11 whose upper end has a transverse sealing band 12. The inner wrapper is enveloped by a cellophane or transparent plastic film outer wrapper 13 which hermetically seals the pack to prevent the loss of moisture from the cigarettes.

To break open the outer wrapper and provide access to the contents of the pack, the outer wrapper includes a tear-off ribbon (not shown) which encircles the wrapper. When the ribbon is uncoiled it decapitates the head of the outer wrapper to expose the inner wrapper. Then by tearing off the portion of the inner wrapper 11 between band 12 and one side, a port is formed from which cigarettes are withdrawn.

Inserted between one face of inner wrapper 11 and the corresponding face of outer wrapper 13 is a flat ultra-thin cigarette lighter generally designated by numeral 14 in a card-like format whose dimensions are approximately the same as those of a typical credit card. Thus in one embodiment of the invention, the dimensions of the lighter are $3\frac{3}{4}$ inches long by $1\frac{7}{8}$ inches wide, with a maximum thickness of $\frac{1}{8}$ of an inch. A lighter having these dimensions may easily be slipped into the space between the wrappers.

Figure 3:
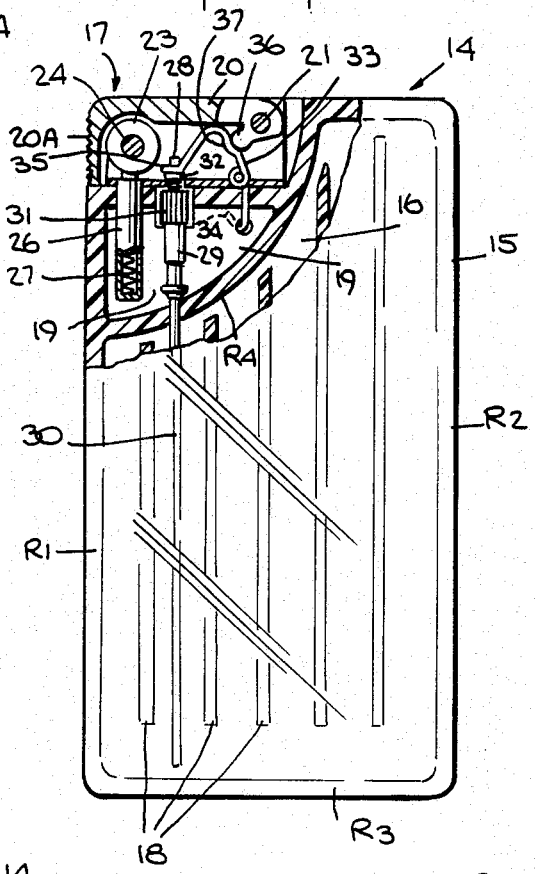
FIG. 3 is a front view, partly in section of the lighter with the hinged cowl thereof closed.
Figure 4:
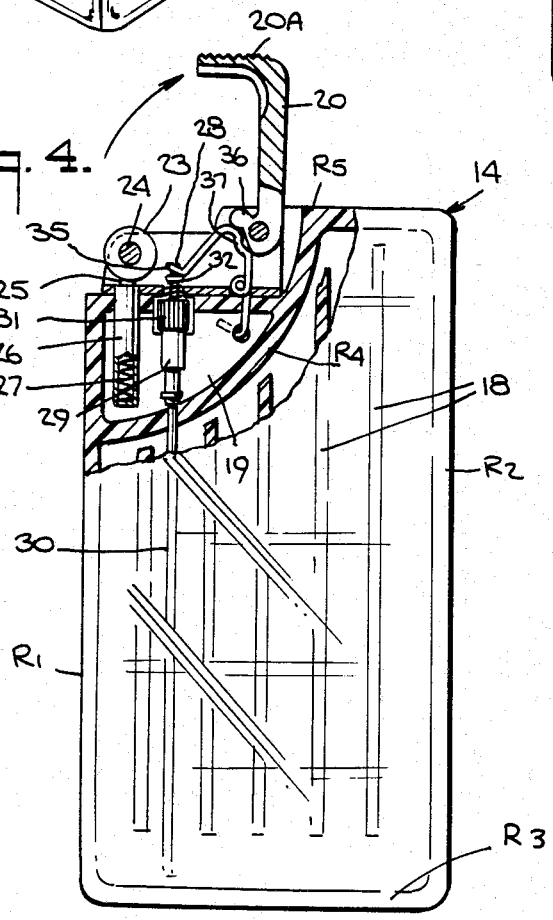
FIG. 4 is the same as FIG. 3 but with the hinged cowl raised to expose the operating components.
Figure 2:
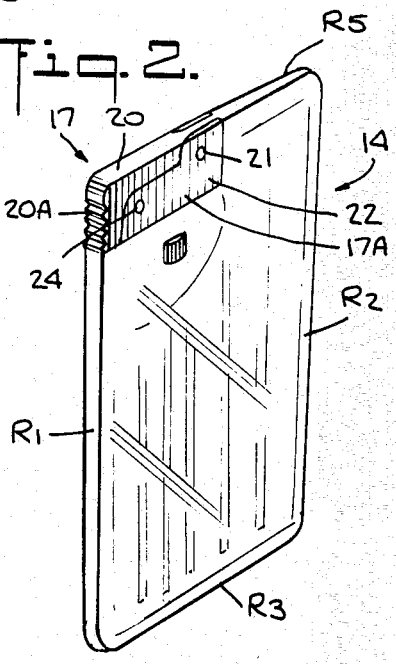
FIG. 2 is a perspective view of the lighter.

As best seen in FIGS. 2, 3 and 4, cigarette lighter 14 includes a rectangular body 15 molded of a non-reactive synthetic plastic material having high-strength, such as acetal resin the main portion of the body being hollow to define a shallow reservoir 16. The outer boundaries of reservoir 16 are defined by straight rims $R_1$ and $R_2$ on the long sides of the body, straight rim $R_3$ on the lower end and an arcuate rim $R_4$ extending from an intermediate point on side rim $R_1$ to an intermediate point on the straight rim $R_5$ on the upper end of the body. The upper left hand corner of the body is provided with a rectangular cut-out to receive the lighter assembly, generally designated by numeral 17.

Reservoir 16 is filled with butane, isobutane, propane or other liquified hydrocarbon mixture whose vapor pressure at 75° F. (24° C.) exceeds an absolute pressure of 30 psi. The reservoir is shallow and the walls thereof have an area of several square inches which are exposed to a relatively high pressure per square inch. In order therefore to withstand this pressure, the front and rear walls of the reservoir are joined together by an array of reinforcing ribs 18 which are parallel to side rim $R_1$ and $R_2$ and extend from adjacent arcuate rim $R_4$ to a point above lower end rim $R_3$ to define parallel channels having a common outlet as not to block the flow of fluid in the reservoir.

The reinforcing ribs act to prevent dilation of and possibly rupture of the walls of the reservoir by the pressure of fluid. Though the reservoir is thin, its length and width are relatively large compared to those of the reservoir included in conventional lighters. Hence the capacity of reservoir 16 is comparable to that of conventional lighter reservoirs and the present lighter is capable of giving hundreds of lights. Hence when a cigarette pack is exhausted the lighter may be transferred to a fresh pack.

Zone 19 which lies between arcuate rib $R_4$ and the cut-out at the left corner of the body is of solid plastic material and serves to anchor the elements of the lighter assembly which are embedded therein. Assembly 17 includes a metal frame 22 (see FIG. 2) formed by a pair of side plates in parallel relation which are flush with the corresponding walls of body 14. Hinged to the plates of the frame by a pivot pin 21 is an L-shaped cowl 20 whose short leg 20A is knurled to facilitate raising the cowl by the user's thumb.

Disposed within the plates of frame 17A is a thumb wheel 23 which rotates on a pin 24 extending between the plates. Wheel 23 is formed of hardened metal having a toothed periphery which at its underside engages the head of a flint 25. This flint is telescoped in a tube 26 embedded in zone 19. Flint 25 is urged by a helical spring 27 interposed between the flint and the lower end of tube 26 upwardly toward the thumb wheel. When therefore cowl 20 is raised as shown in FIG. 4 and wheel 23 is turned by the user's thumb, it abrades the head of the flint to generate sparks which are directed inwardly.

Adjacent wheel 23 between the side plates of frame 22 is a vertical nozzle 28. This is mounted above a valve 29 whose inlet is coupled to reservoir 16 through a pressure reducing wick 30 extending therein in the channel formed between adjacent ribs 18. The valve may be of the adjustable type disclosed in U.S. Pat. No. 4,036,570 or in the patents listed in column 2 therein relating to lighters using butane fuel. The valve is adjustable by means of a knurled wheel 31 which fits into a window cut in zone 19 so that it can be manipulated by the fingers of the operator to set the height of the flame.

Valve 29 is opened and closed by a spring-biased actuating ring 32 which surrounds nozzle 28, such that when the ring is depressed it acts to close the valve and when the ring is released it acts to open the valve to an extent determined by the setting of wheel 31.

The valve action is controlled by a wire spring 33 which is anchored on the bed on frame 22 and is provided with a barbed extension 34 that is embedded in solid zone 19 to hold the frame in place. The free end of the spring is formed into a loop 35 which surrounds nozzle 28 to engage valve actuating ring 32. Cowl 20 is provided with a cam 36 which extends from pivot 21 into a curved section 37 of the wire spring, this curved section functioning as a detent.

When cowl 20 is closed, cam 36 lies within detent 37 to force loop 35 to depress ring 32 to close the valve, as shown in FIG. 3. When cowl 20 is thereafter raised as shown in FIG. 4, the cam rides out of detent 37 to cause loop 32 to rise above and release ring 32 to open the valve.

Thus when cowl 20 is shut, the fuel valve is closed, and when the cowl is lifted by the thumb of the user the valve is then open, at which point the user has only to turn the thumb wheel 23 with his thumb to generate sparks to ignite the vapor emitted from nozzle 28. Since the user's thumb lies against wheel 23 when the cowl is raised thereby, the action of raising the cowl and then turning the wheel may be carried out quickly with an upward thumb movement followed by a downward movement.

The thickness of the lighter assembly 17 determines the maximum thickness of the associated lighter body. In practice, the body as one moves away from the left corner cut-out containing the lighter assembly may be feathered to facilitate insertion between the inner and outer wrappers of the cigarette pack.

While there have been shown and described preferred embodiments of a flat cigarette lighter in accordance with the invention, it will be appreciated that many changes and modifications may be made therein without, however, departing from the essential spirit thereof. Thus the lighter assembly need not be in the form illustrated herein but may be of a single-action push button type in which a user presses a button inwardly with his thumb. The button pushes a plunger which operates a rack to turn a flint wheel and also operates a mechanism to open the normally-closed fuel valve.

I claim:

1. In combination with a standard soft cigarette pack wherein cigarettes are housed within an inner wrapper to form a crushable body which is enveloped and sealed within an outer wrapper having a rectangular face, said inner wrapper having a corresponding face which is spaced from the outer wrapper face by the insertion therebetween of a flat, ultra-thin cigarette lighter when the top portion of the outer wrapper is removed to provide access to the cigarettes, whereby the inserted lighter then functions as a stiffener to resist crushing of the pack without substantially altering the overall dimensions thereof, said lighter comprising:

A a shallow generally rectangular container having a card format molded of synthetic plastic material to provide a reservoir which is filled with a liquefied gas that subjects the container to high internal pressure, said container having front and rear walls defined by parallel plates which are joined together by ribs to resist the pressure produced by the liquefied gas, said container having a width approaching the width of said wrapper faces, a length that is somewhat shorter than that of the wrapper faces and a thinness which allows insertion of the container in the space between said wrapper faces without distortion of the pack; and B a lighter assembly mounted on the upper portion of the container and having substantially the same thinness, said assembly including a normally-closed valve whose inlet is coupled to the reservoir, a nozzle communicating with the valve to emit said gas when the valve is opened, a spark generator adjacent said nozzle, said generator, when actuated, producing sparks, and a manually-operated actuator operatively coupled to said valve, whereby when the actuator is operated it acts to open said valve to cause gas to be emitted from said nozzle to be ignited by sparks from the generator.

2. The combination as set forth in claim 1 wherein said liquefied gas is butane.

* * * * *